US005651254A

United States Patent [19]

Berry

[11] Patent Number: 5,651,254

[45] Date of Patent: Jul. 29, 1997

[54] WINE COOLER

[76] Inventor: Steven Kenneth Berry, 13101 San Simeon Ave., Bakersfield, Calif. 93312

[21] Appl. No.: 572,108

[22] Filed: Dec. 14, 1995

[51] Int. Cl.[6] ..... F25D 3/08

[52] U.S. Cl. ..... 62/1; 62/457.4

[58] Field of Search ..... 62/1, 371, 457.3, 62/457.4, 457.5

[56] References Cited

U.S. PATENT DOCUMENTS

| | | | |
|---|---|---|---|
| 929,389 | 7/1909 | Clement | 62/371 |
| 2,629,515 | 2/1953 | Asplund | 62/1 |
| 4,543,801 | 10/1985 | Damiens | 62/457 |
| 4,625,518 | 12/1986 | Freedman | 62/1 |
| 4,823,974 | 4/1989 | Crosser | 62/457.3 |
| 4,960,225 | 10/1990 | Gillis | 220/85 H |
| 5,148,682 | 9/1992 | Wolf | 62/59 |
| 5,177,981 | 1/1993 | Haas | 62/457.3 |
| 5,419,856 | 5/1995 | Shaw | 264/28 |

*Primary Examiner*—William Doerrler
*Attorney, Agent, or Firm*—Patent & Trademark Services; Joseph H. McGlynn

[57] ABSTRACT

A freezable container which uses water that is frozen to keep a beverage cold and which does not require that the beverage be placed into the freezer along with the container filled with water. The freezable container has a sleeve placed concentrically inside the container. The sleeve is held in place by a pair of rods which pass over one another and the rods are secured to both the sleeve and the container. Water is placed between the container and the sleeve and both are placed in the freezer. When the water has frozen, the container is removed from the freezer and the sleeve is removed from the container. Now a beverage container may be placed into the container in place of the sleeve and the beverage will be kept cold by the ice in the container.

5 Claims, 1 Drawing Sheet

WINE COOLER

BACKGROUND OF THE INVENTION

This invention relates in general to cooling devices and in particular to containers that will cool various types of liquids.

DESCRIPTION OF THE PRIOR ART

In the prior art various types of coolers have been disclosed. For example, U.S. Pat. No. 4,543,801 discloses a wine cooler serving apparatus which consists of a container for water. The wine bottle is placed in the water and the entire container is then placed in the freezer. U.S. Pat. No. 4,625,518 discloses an ice mug comprising a container which can be frozen and a detachable handle which is not frozen. U.S. Pat. No. 4,960,225 discloses a cover with indicia that can be placed over a beverage can. U.S. Pat. No. 5,148,682 discloses a two part container filled with water. A beverage bottle is placed in the container and the entire container and beverage bottle are placed in the freezer. Although the concept of a cooler for beverages is well known, all the prior art devices require that the beverage and the container be placed in the freezer. This will sometimes cause a space problem in the freezer compartment. Also, freezing certain types of beverages can affect the taste of the beverage.

SUMMARY OF THE INVENTION

The present invention is directed to a freezable shell which uses water that is frozen to keep a beverage cold and which does not require that the beverage be placed into the freezer along with the shell filled with water. The freezable shell has a sleeve placed concentrically inside the shell. The sleeve is held in place by a pair of rods which pass over one another and the rods are secured to both the sleeve and the shell. Water is placed between the shell and the sleeve and both are placed in the freezer. When the water has frozen, the shell is removed from the freezer and the sleeve and the shell are removed leaving an ice container. Now a beverage container may be placed into the ice container in place of the sleeve and the beverage will be kept cold by the ice.

For special occasions, the ice container can be dressed up by placing articles such as flowers, leaves, or fruit slices into the water before the shell is placed in the freezer. This will increase the aesthetic quality of the container.

It is an object of the present invention to provide a new and improved apparatus for cooling, serving, and for continued cooling and storage of a beverage.

It is an object of the present invention to provide a new and improved apparatus for cooling beverages which is convenient, attractive and adds enjoyment when serving the beverage to guests.

These and other objects and advantages of the present invention will be fully apparent from the following description, when taken in connection with the annexed drawings.

DESCRIPTION OF THE PREFERRED EMBODIMENT

Figure 1:
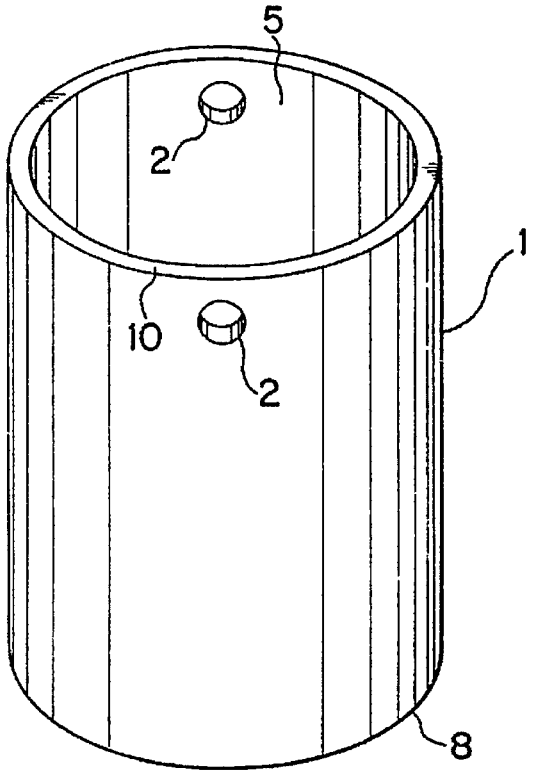
FIG. 1 is a perspective view of the shell.

Referring now to the drawings in greater detail, FIG. 1 shows a perspective view of the shell 1 of the present invention. The shell shown is circular, however the shape is not critical and virtually any shape may be used without departing from the scope of the invention. The shell has a solid bottom 8 and an open top 5 with a rim 10 surrounding the open top. Placed on the sides of the shell 1 are two apertures 2 for a purpose to be described later.

Figure 2:
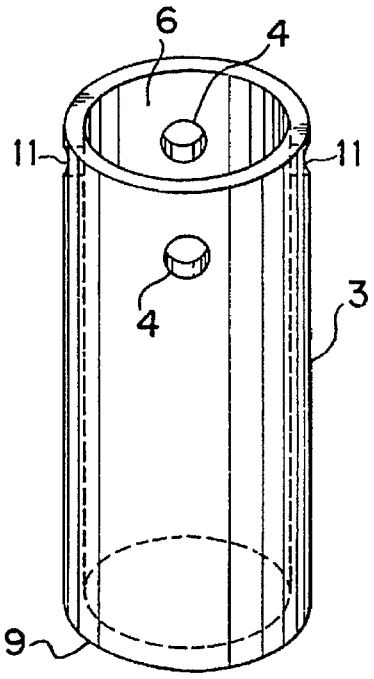
FIG. 2 is a perspective view of the sleeve.
Figure 3:
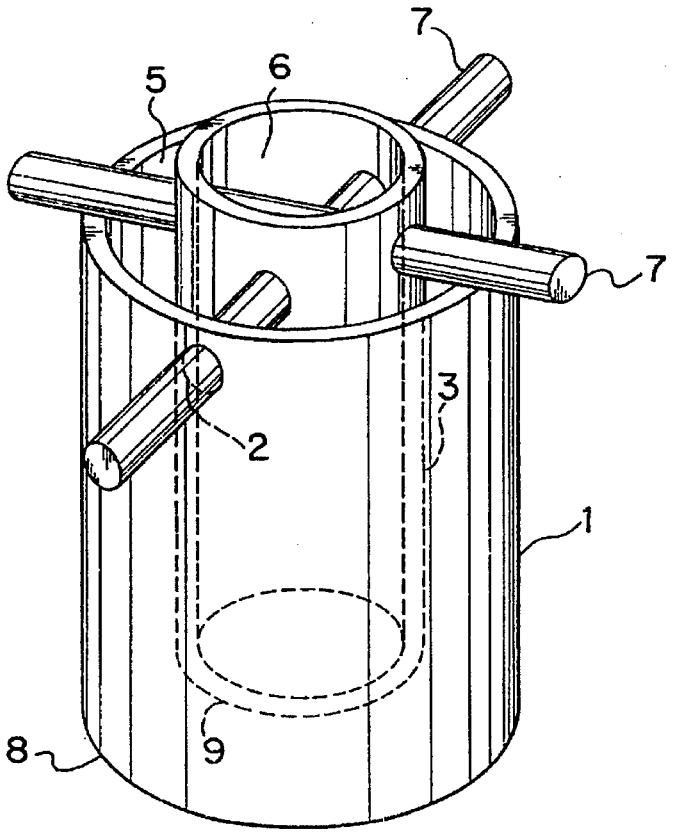
FIG. 3 is a perspective view of the sleeve in the shell.

FIG. 2 shows the sleeve 3 which has a closed bottom 9 and an open top 6. Spaced around the circumference of the sleeve are four apertures 4 and 11. The apertures 4 are slightly lower on the wall of the cylinder 3 so they will be aligned with the apertures 2 in the shell 1. When the sleeve 3 is placed inside the shell 1, as shown in FIG. 3, the apertures 4 will align with the apertures 2. The lower portion of apertures 11 will align with the top of the rim 10 on shell 1. The sleeve, like the shell, is shown circular, however the shape is not critical and virtually any shape may be used without departing from the scope of the invention.

When it is desired to prepare the shell for cooling beverages, one of the rods 7, shown in FIG. 3, is passed through the apertures 11 and the rod and the sleeve 3 are placed in shell 1. The rod will rest on the rim 10, and the sleeve 3 can be rotated until the apertures 4 and 2 are aligned. Then another rod 7, is passed through the aligned apertures 4 and 2, to secure the sleeve 3 in the shell 1. Since the apertures 4 are lower than the apertures 11 the rods will pass each other with no interference. The height of the sleeve 3 will be less than the height of the shell 1 so there will be a space between the bottom 9 of the sleeve and the bottom 8 of the shell 1. Water will then be poured between the outside of the sleeve 3 and the inside of the shell 1, and the entire unit will be placed into the freezer until the water is solid ice.

When it is time to use the cooler, the unit will be removed from the freezer and the sleeve 3 and the rods 7 will be removed leaving a cavity formed from ice. Then the shell 1 will be removed leaving only the ice container. A bottle or some other type of container containing any type of beverage can then be placed in the ice cavity and the beverage will be cooled.

Other modifications can be made to the cooler without departing from the scope of the invention. For example, articles such as flowers, leaves, or fruit slices can be placed into the water before the shell is placed in the freezer. When the water freezes, the articles will be dispersed throughout the water. The shell 1 can be made of transparent plastic which will allow the articles to be seen through the walls of the shell. This will increase the aesthetic quality of the container.

Although the cooler shell and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A cooler for use with a beverage container to cool a beverage in said beverage container, said cooler comprising:

shell means for holding a freezable liquid, said shell means having a bottom, at least one wall and an open top, said at least one wall having a pair of apertures adjacent said top, a sleeve having a bottom, at least one wall and an open top, said sleeve having two pair of apertures positioned in said at least one wall below said open top of said sleeve, holding means passing through said two pair of apertures in said sleeve, and said apertures in said shell means for holding said sleeve suspended within said shell means, whereby a liquid is adapted to be placed between said shell means and said sleeve and frozen, after which said sleeve is adapted to be removed from said shell means leaving a container made of ice, and a container with a beverage inside may be inserted into said container made of ice and cooled.

2. The cooler as claimed in claim 1, wherein one pair of said two pair of apertures in said sleeve is positioned lower in said at least one wall than another pair of said apertures.

3. The cooler as claimed in claim 1, wherein said holding means passing through said two pair of apertures in said sleeve is a pair of rods.

4. The cooler as claimed in claim 1, wherein said shell means is made from transparent plastic.

5. A method of using a cooler to cool a beverage in a beverage container, said cooler comprising a shell having a closed bottom and an open top with a pair of apertures positioned adjacent said open top of said shell, and a sleeve having a closed bottom and an open top with two pair of apertures positioned adjacent said open top of said sleeve, and a pair of rods, said method comprising:

placing one of said rods through one of said pair of apertures in said sleeve, placing said sleeve within said shell with said rod resting on the top of said shell, aligning the remaining pair of apertures in said sleeve with the pair of apertures in said shell, placing another of said rods in said aligned apertures, placing a liquid between said shell and said sleeve, placing said shell, said sleeve and said liquid in a freezer until said liquid is frozen, removing said shell, said sleeve and said liquid from said freezer, removing said sleeve and said rods from said shell, removing said shell leaving a formed ice container, placing a beverage container inside said formed ice container.

* * * * *